US008865034B2

(12) United States Patent
Poulin

(10) Patent No.: US 8,865,034 B2
(45) Date of Patent: Oct. 21, 2014

(54) SYSTEM FOR BUILDING FORMWORK FOR CONCRETE STAIRS AND RELATED METHODS

(71) Applicant: Stephane Poulin, Val-des-Monts (CA)

(72) Inventor: Stephane Poulin, Val-des-Monts (CA)

(73) Assignee: Stéphane Poulin, Val-des-Monts (CA)

( * ) Notice: Subject to any disclaimer, the term of this patent is extended or adjusted under 35 U.S.C. 154(b) by 0 days.

(21) Appl. No.: 13/753,039

(22) Filed: Jan. 29, 2013

(65) Prior Publication Data

US 2014/0021643 A1 Jan. 23, 2014

Related U.S. Application Data

(60) Provisional application No. 61/673,785, filed on Jul. 20, 2012.

(30) Foreign Application Priority Data

Dec. 31, 2012 (CA) ..... 2801091

(51) Int. Cl.
*E04G 13/06* (2006.01)

(52) U.S. Cl.
CPC ..... *E04G 13/062* (2013.01); *E04G 13/06* (2013.01)
USPC ..... 264/34; 425/63; 425/65; 264/33; 264/35; 249/14

(58) Field of Classification Search
CPC ..... E04G 13/06; E04G 13/062
USPC ..... 425/63, 65; 264/33, 34, 35; 249/14
See application file for complete search history.

(56) References Cited

U.S. PATENT DOCUMENTS

| | | | | |
|---|---|---|---|---|
| 3,780,976 | A * | 12/1973 | Messier | 249/14 |
| 4,444,374 | A * | 4/1984 | Gramstad | 249/14 |
| 4,846,437 | A * | 7/1989 | Fitzgerald | 249/3 |
| 4,916,796 | A * | 4/1990 | Baumgartner | 29/407.05 |
| 2009/0266970 | A1 * | 10/2009 | Sladojevic | 249/14 |
| 2011/0162303 | A1 * | 7/2011 | Truckner et al. | 52/183 |
| 2011/0240831 | A1 * | 10/2011 | Merriam | 249/14 |

* cited by examiner

*Primary Examiner* — Joseph S Del Sole
*Assistant Examiner* — Lawrence D Hohenbrink, Jr.
(74) *Attorney, Agent, or Firm* — Goudreau Gage Dubuc; Isabelle Pelletier

(57) ABSTRACT

The present invention provides a system to build formworks for building concrete stairs which is durable and reusable, which can be rapidly mounted and dismantled on site and which is adjustable to a variety of flight of stairs having different widths, rises and pitches. The system comprises (a) at least one side plate which can be releasably secured to a supporting structure on a footing; the side plate defining a side of at least one stair and defining the depth of a tread of said stair; (b) at least one riser member for defining the rise of the at least one stair; the riser member being complementary to the side plate; and (c) means for fastening the riser member to the side plate; wherein the side plate and riser member are reusable.

17 Claims, 11 Drawing Sheets

SYSTEM FOR BUILDING FORMWORK FOR CONCRETE STAIRS AND RELATED METHODS

CROSS REFERENCE TO RELATED APPLICATIONS

This application claims benefit of U.S. provisional application Ser. No. 61/673,785, filed on Jul. 20, 2012 and of Canadian Application No. 2,801,091 filed on Dec. 31, 2012. All documents above are incorporated herein in their entirety by reference.

STATEMENT REGARDING FEDERALLY SPONSORED RESEARCH OR DEVELOPMENT

NA

FIELD OF THE INVENTION

The present invention relates to formwork for building concrete stairs. More specifically, the present invention is concerned with adjustable metal casings for creating formworks for building concrete stairs.

BACKGROUND OF THE INVENTION

In typical concrete stairway systems, it has been common practice to construct formwork, comprised of various elements at a building site to receive concrete and form the stair structure. The function of the formwork is primarily directed to the retention and control of the concrete when the structure is being erected. The formwork is typically made of wood and discarded once the concrete has been poured and has hardened. Because wood often bends under the load of concrete, wood formworks often need to be reinforced, especially in larger structures. Thus, the building of formwork for building concrete stairs requires much time, effort and materials which are all wasted once the project is finished because the formwork is typically completely discarded when the structure has been completed.

The present description refers to a number of documents, the content of which is herein incorporated by reference in their entirety.

SUMMARY OF THE INVENTION

An object of the present invention is thus to provide a system which is durable and reusable, which can be rapidly mounted and dismantled on site and which is adjustable to a variety of flight of stairs having different widths, rises and pitches.

More specifically, in accordance with the present invention, there is provided a casing system for building a formwork for building concrete stairs comprising: (a) at least one side plate which can be releasably secured to a supporting structure on a footing; the side plate defining a side of at least one stair and defining the depth of a tread of said stair; (b) at least one riser member for defining the rise of the at least one stair; the riser member being complementary to the side plate; and (c) means for fastening the riser member to the side plate; wherein the side plate and riser member are reusable.

In an embodiment, the side plate comprises holes enabling to releasably secure the side plate to the supporting structure. In a particular embodiment, the side plate is releasably secured to the supporting structure using screws or nails.

In another embodiment, the side plate is adaptable and can be used to build stairs having treads of varying depths, preferably of depths between 9 inches and 25 inches.

In a particular embodiment, the side plate defines the side of at least two stairs, at least 3 stairs, at least 4 stairs, at least 5 stairs or at least 6 stairs.

In a further embodiment the side plate is integrally formed i.e., made in a single piece of material.

In another embodiment, the side plate and the riser member further define a nosing along the tread of a stair. The nosing may be present along the entire periphery of the tread or only on a portion thereof (only the front of the tread).

The side plate may further comprises a support member for supporting a riser member. In an embodiment, the support member is integrally formed with the side plate. In another embodiment, the support member comprises an indentation to receive the riser member. In yet another embodiment, the support member is a comb having multiple teeth and indentations to receive the riser member.

The above described system may advantageously comprise in accordance with the present invention one or more fastening means to fasten the riser member to the side plate. In an embodiment, the fastening means is a clamp for clamping the riser member to the side plate. In a preferred embodiment, the clamp is a c-shaped clamp and the side plate further comprises a locking member to lock the clamp on the side plate.

In an embodiment, the side plate and riser member are made of stainless steel. In a particular embodiment, the stainless steel is ¼ inch thick.

In a further embodiment, the riser member is up to 12 feet long. In a particular embodiment, the riser member is 6, 8, 10 or 12 feet long.

In another embodiment, the system further comprises at least one relay plate for securing the riser member to a wall and enabling the building of formwork for building a flight of stairs along the wall.

In a related aspect, the present invention relates to a use of the above-described system for building a formwork for building concrete stairs.

Other objects, advantages and features of the present invention will become more apparent upon reading of the following non-restrictive description of specific embodiments thereof, given by way of example only with reference to the accompanying drawings.

DESCRIPTION OF ILLUSTRATIVE EMBODIMENTS

The present invention is illustrated in further details by the following non-limiting examples.

Figure 1:
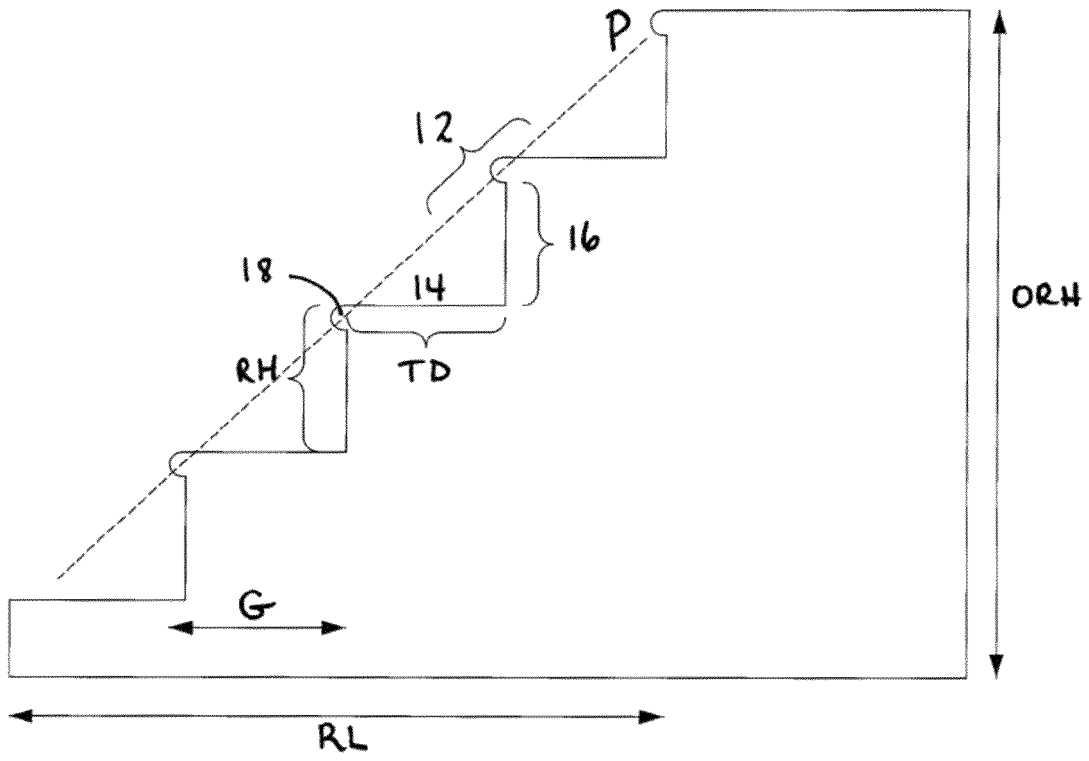
FIG. 1 is a side view of a typical flight of stairs showing measurements of rise height (RH), overall rise height (ORH), tread depth (TD), run length (RL), going (G) and pitch line (P)

The system of the present invention can advantageously be used to build a formwork for flight of stairs of various sizes and shapes. A typical flight of stairs (10) is shown in FIG. 1. The flight of stairs (10) consists of a number of stairs (12) and usually a landing or platform at the top and/or bottom. An intermediate platform may also be built as part of the stairs between the bottom and the top levels and is typically used to allow the stairs to change direction or to allow the user to rest. Each individual set of stairs (12) consists of a step or tread (14) and a riser (16). The tread is the part of the stairs that is stepped on. The riser (16) extends upwardly or downwardly from an edge of a tread (14) and connects a tread to an adjacent tread. The riser (16) is thus the vertical portion between each tread on a flight of stairs. The tread (14) may optionally comprise a nosing (18) which is positioned at the edge of the tread opposite to the rise, along its width and (optionally along its depth) and forms the part that protrudes over the riser (16) beneath.

The overall height of a flight of stairs is called the overall rise height (ORH) and the overall length of the stairs is the run length (RL). The rise height (RH) of each step is measured from the top of one tread to the next. The ratio of rise height to run length is the pitch (P). The width (W) of a tread is measured from one side to the other and the tread depth (TD) is measured from the outer edge of the nosing (18) to the riser (16) on the opposite edge. The going of a step (G) is the horizontal distance from the edge of the nosing of a step to the edge of the nosing of the adjacent step. The number of stairs (12) in a flight of stairs is deduced by the number of risers present. In the example shown in FIG. 1 there are 4 risers and therefore it is a 4-step flight of stairs.

A typical concrete flight of stairs is made using two stringers which are the structural members that support the risers. When building concrete stairs, a footing is first typically built. The footing is generally made of gravel (filling) and concrete (shell) but it can also be made using other materials. A wood frame may also be created such that no footing or base per se is build and the flight of stairs is cantilevered/hanging. The footing forms the base on which the concrete stairs will be supported.

In conventional methods of building formwork for concrete stairs, two stringers, usually made of plywood are secured to the footing and used to form the formwork of a flight of stairs. Risers are then supported and attached onto the two stringers on each side to enable the building of steps and retain the concrete when pouring. The treads (steps) are formed in concrete. Thus, a typical formwork for building concrete stairs does not comprise tread but only risers and stringers. Typical formworks are discarded once the concrete has been poured and has hardened. The building of formworks for building concrete stairs thus requires much time, effort and materials which are all wasted once the project is finished because the formworks are typically completely discarded when the structure has been finished.

Accordingly, the present invention provides a system for creating formworks for building concrete stairs which is easy to installed, requires much less time and efforts compared to typical formworks and is reusable. It uses up to 90% less wood and does not require the use of bracings (reinforcing structures) for stairs up to 12 feet wide.

Figure 2:
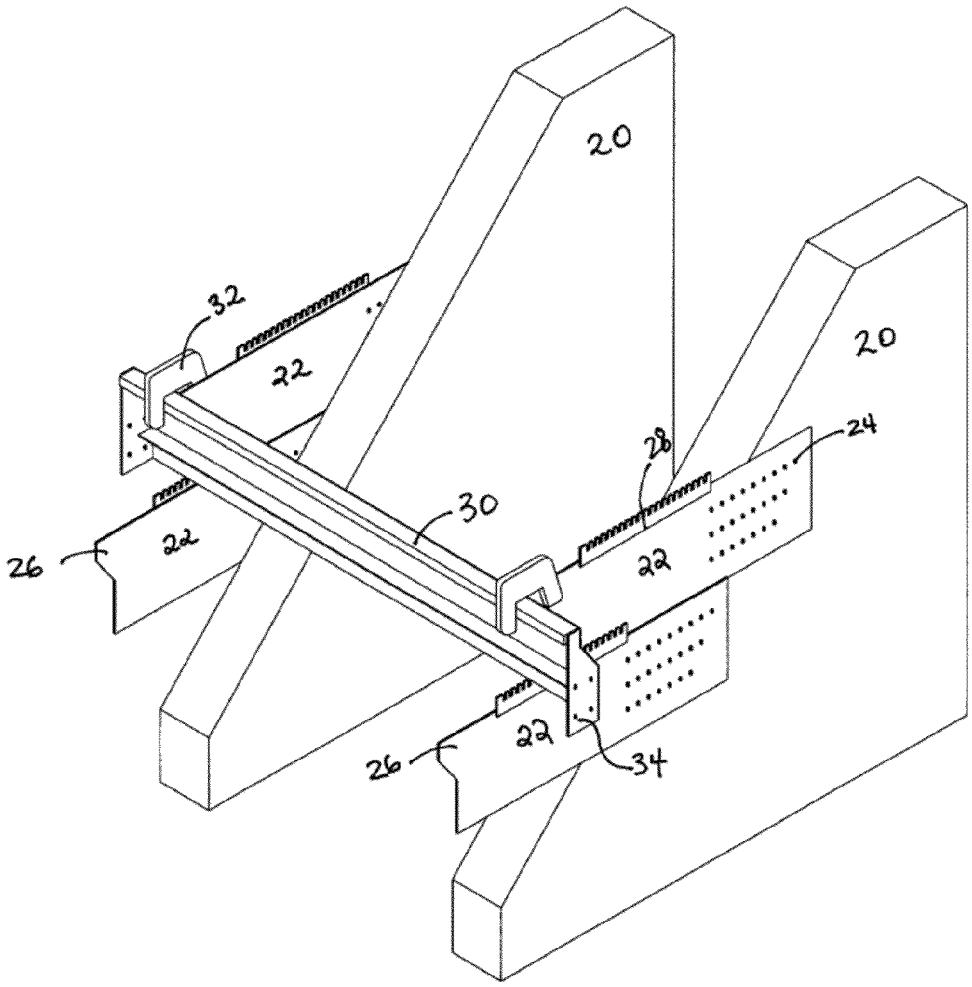
FIG. 2 is a perspective view of an embodiment of a system of the present invention installed on a two-sided structure (wood support fixed on a concrete footing)
Figure 3:
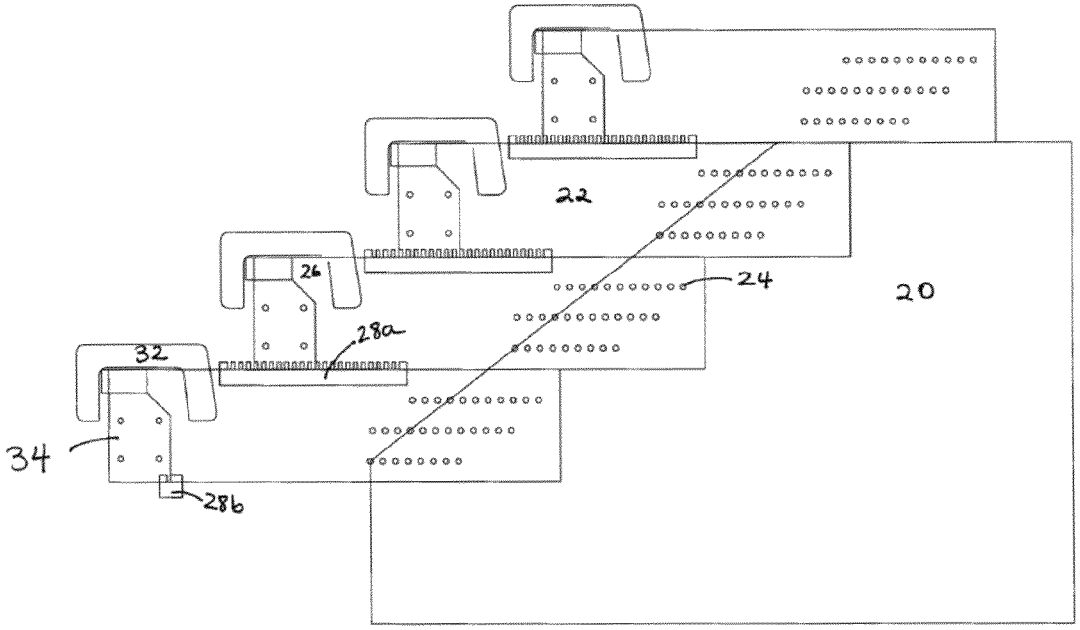
FIG. 3 shows a side view of the embodiment shown in FIG. 2.
Figure 4:
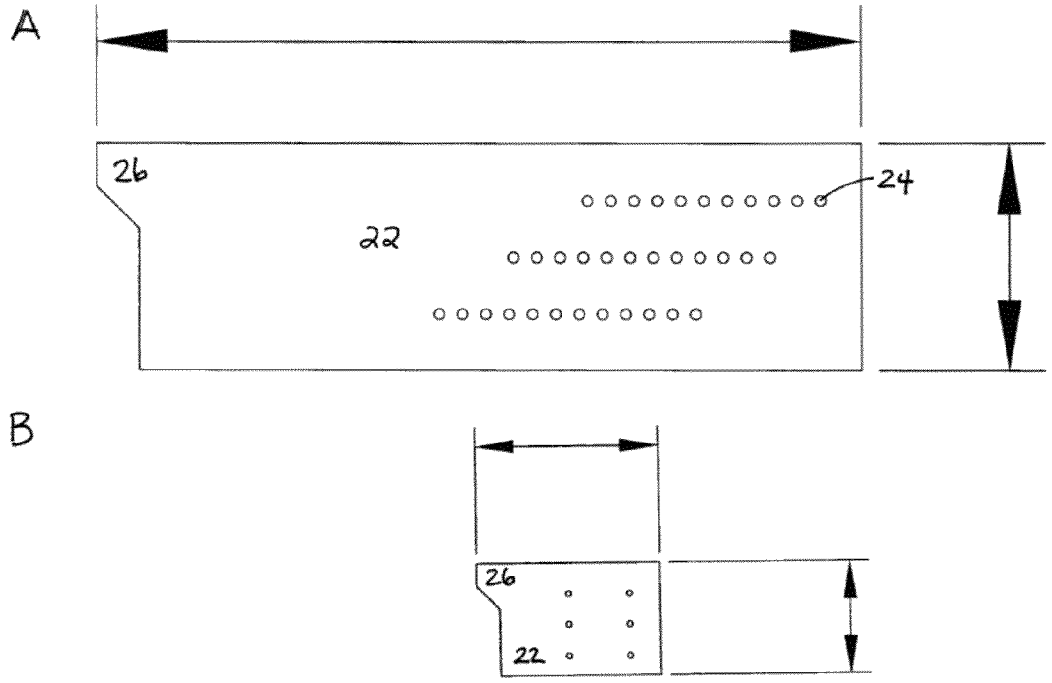
FIG. 4 shows two embodiments (A and B) of side plates of the present invention.
Figure 10A:
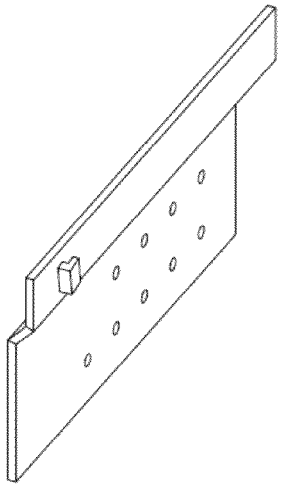
FIG. 10 shows a second embodiment of a side plate of a metal casing system of the present invention. The side plate shown in FIGS. 10A, B and C differs from the first embodiment of the present invention in that the side plate enables to continue or carry the nosing of a step on its side. This embodiment is adjustable at a 45° degree angle. A is a perspective view of a second embodiment of a side plate of the present invention. B is a side view of the second embodiment of a side plate of the present invention. C. is a front view of the second embodiment of a side plate of the present invention shown in FIGS. 10A and B.
Figure 10B:
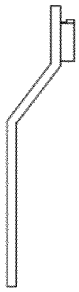
Figure 10C:
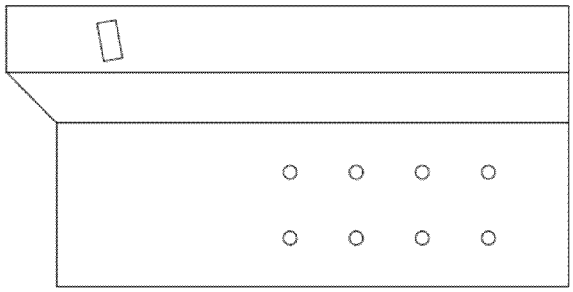

Referring now to FIGS. 2 and 3, there is shown a first embodiment of a metal casing system of the present invention enabling the construction of a formwork for building concrete stairs. The system comprises side plates (22) which define the side of a stair or stairs. Once a suitable footing or base has been built, side plates are mounted on each side of the footing/base. Preferably a supporting structure or stringer (20) such as a wood beam or plywood sheet is first mounted (e.g., nailed) on each side of the footing and the side plates are then screwed or nailed on the supporting structure to avoid damaging the concrete covering the base or footing. The side plates (22) comprise a series of holes (24) which are used to fasten the plates to the supporting structure or stringer (20). In the embodiments shown in the figures, the holes are ⅜ inch wide but any suitable size is acceptable as long as it allows the side plate (22) to be secured to the supporting structure. In the first embodiment shown in FIGS. 2, 3 and 4A and the embodiment shown in FIG. 10, the holes (24) advantageously allow the side plates (22) to be adjusted to create a stair with a tread of desired depth. Thus, the side plates (22) are used to define the depth of the tread (14) or step on a given stair. In such an embodiment of the present invention, when a flight of stairs comprising several stairs or steps is built, side plates can be independently adjusted such that each tread has the same or a different depth.

Figure 9A:
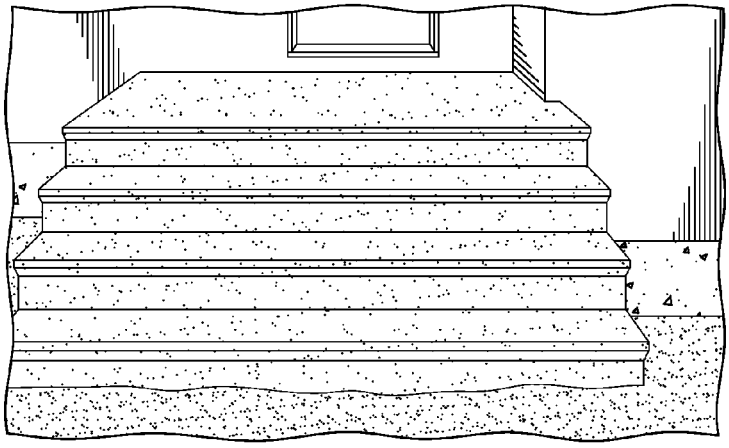
FIG. 9 shows staircases comprising concrete stairs built using the metal casing system depicted in FIGS. 2, 3 and 6 to 8. A. front view of a finished staircase with concrete stairs built using the metal casing system of the present invention. B is a perspective view of another staircase built using the metal casing system of the present invention. C is a side view of a further staircase built using the metal casing system of the present invention clearly showing the nosing on each step.
Figure 9B:
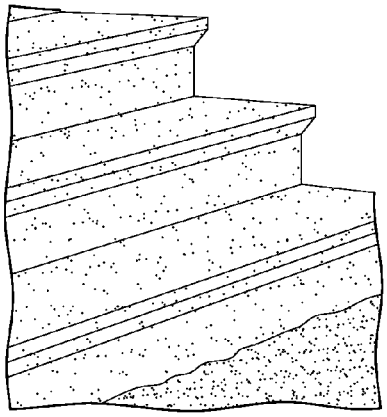
Figure 9C:
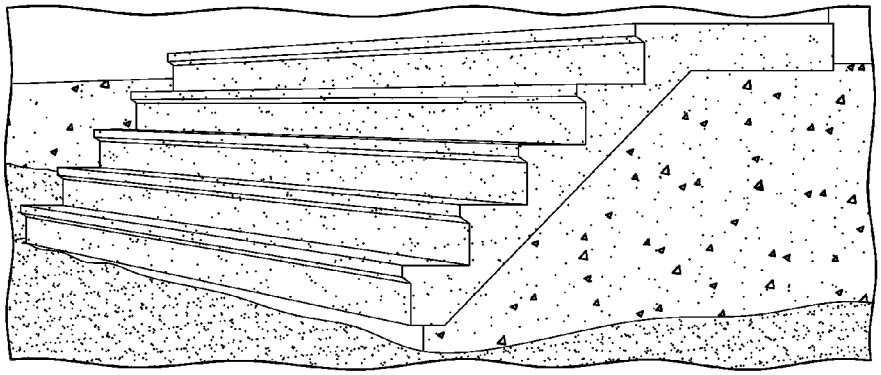

In a particular embodiment, the side plates can be designed to optionally enable the creation of a nosing on an edge of a tread. As shown on FIGS. 2-4 and 11, the side plates (22) comprise a protrusion (26) on one edge which defines the shape of the nosing (18) on a tread (14). Using the metal casing system for building formworks for concrete stairs shown in FIGS. 2-8, a nosing (18) is formed at the edge of a tread opposite to a rise, along its width and forms the part that protrudes over the riser (16) beneath. This is best shown on FIGS. 9B and C, which show finished concrete stair flights built using the casing system of the present invention and in particular using the side plates illustrated in FIGS. 2-4.

In the embodiment shown in FIGS. 2, 3 and 4A, the side plate (22) is made of ¼ inch thick steel. It is 27 inches long (including the protrusion (26) defining the nosing (18)) and 7⅜ or 8 inches high. In the embodiment shown in FIG. 4B, the side plate (22) is 12 inches long (including protrusion (26)) and 7⅜ inches high. Similarly, the side plate is made of ¼ inch thick steel.

Optionally, the nosing (18) can be continued over the side of the tread, along its depth. This is possible using, for example side plates 22*a* such as that depicted in FIG. 10. In this particular embodiment, the upper portion of the side plate (22*a*) comprising the protrusion (26) defining the design of the nosing is positioned away from the lower portion comprising the holes (24), allowing the plate to be fastened on the supporting structure or stringer (20). The distance between the lower portion (LP) comprising holes (24) and the upper portion (UP) defines the depth of the side nosing (26*a*). In a preferred embodiment, the side plate 22*a* is 7⅜ inches high. The lower portion (LP) is 4⅜ inches high and the upper portion (UP) is 1½ inches high. The middle portion (MD) is positioned at a 45° angle and is 1½ inches high (see in particular FIGS. 10B and C).

Figure 11:
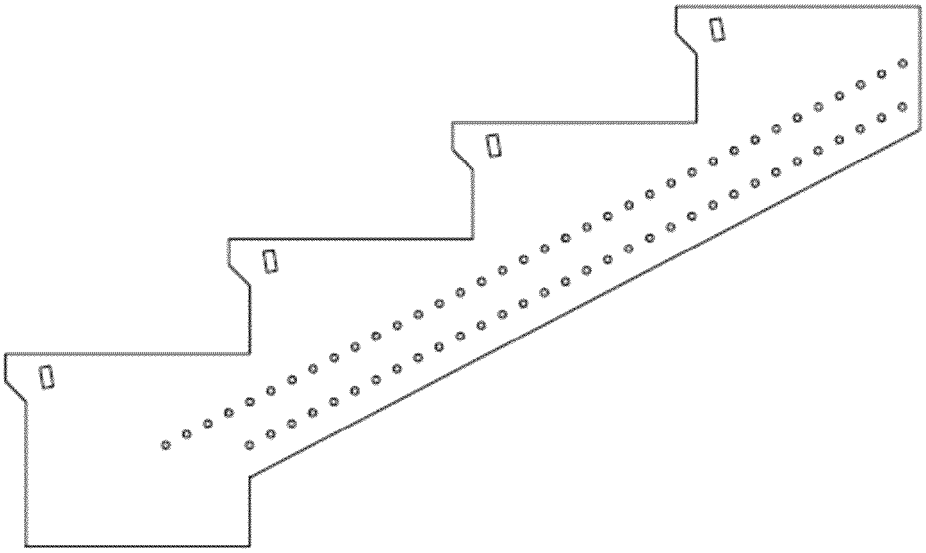
FIG. 11 shows a side view of a third embodiment of a side plate of a metal casing system of the present invention. The side plate is integrally formed and used to build 4 concrete steps.

In another embodiment and turning now to FIG. 11, the side plate (22) of the present invention may be designed such that it can define the shape and support the side of several stairs. For example, it can be made in a single piece designed to accommodate 3, 4, 5, 6, 7 or 8 stairs. Multiple units of such side plates (22) can also be used together to build a flight of stairs of desired length. This design is advantageously used for building multiple houses with repetitive architecture, although it is not adjustable. Another advantage of this design is that it is more rapidly installed. The side plate (22) (and riser members (30)) are installed as described for the embodiments shown in FIGS. 2, 3 and 6-9.

Going back to FIGS. 2 and 3, the casing system of the present invention further comprises a riser member (30) to retain the concrete and to shape the riser (16) of a stair (12). The riser member (30) abuts to the outer edge of the side plate (22) such that it prevents concrete from leaking. The riser member (30) is thus, complementary (i.e., it mates) to the design of the side plate (22). For example, in the embodiment shown on FIGS. 2 and 3, the riser member (30) comprises an indentation or curve that is complementary to the protrusion (26) on the side plate (22) to enable the creation of a nosing (18) along the edge of a tread (14). The riser member may be of any suitable length and up to 12 feet long. Preferably, the riser member is 6, 8, 10 or 12 feet long.

Figure 5:
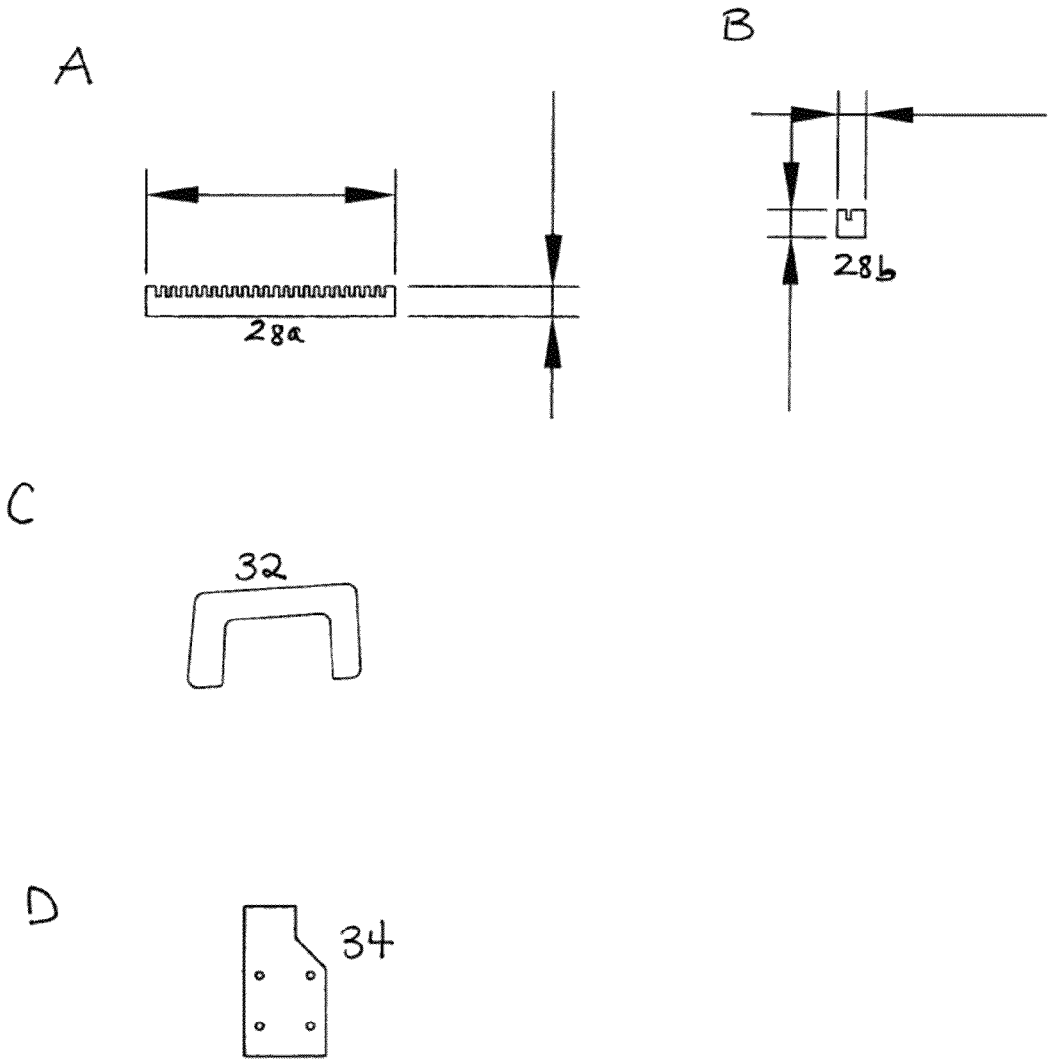
FIG. 5A shows a plan view of an embodiment of a support member of the present invention in the form of a comb.
FIG. 5B is also a plan view of a further embodiment of a support member of the present invention having a single indentation.
FIG. 5C is a plan view of an embodiment of a fastening means of the present invention.
FIG. 5D is a plan view of an embodiment of a relay plate of the present invention.
Figure 6:
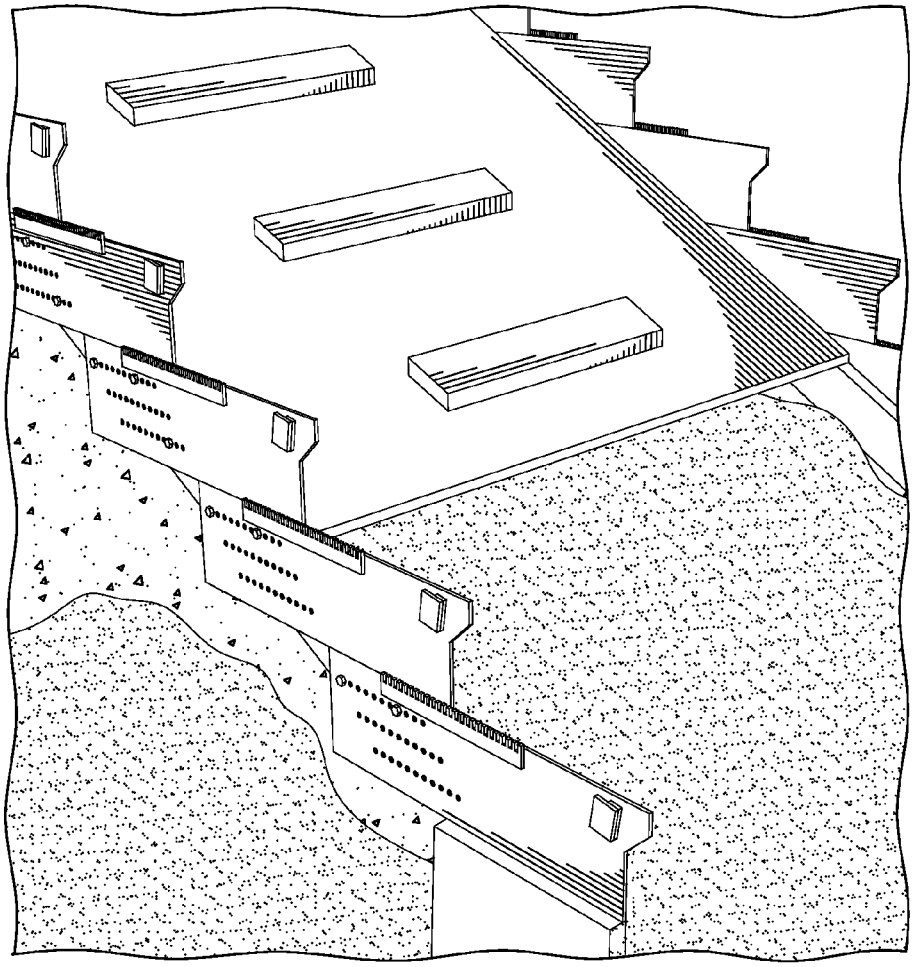
FIG. 6 shows a side view of an unfinished concrete stairway with side plates installed on a wood beam fixed on a concrete footing.
Figure 7A:
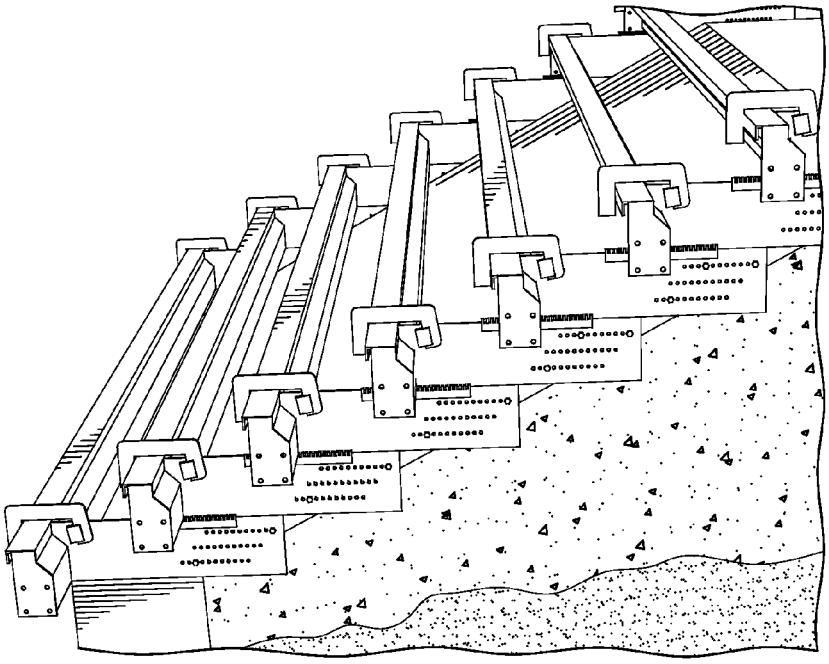
FIGS. 7A and B show the metal casing system depicted in FIGS. 2 and 3, fully installed on two wood beams fixed on each side of a concrete footing, prior to concrete pouring to form the stairs.
Figure 7B:
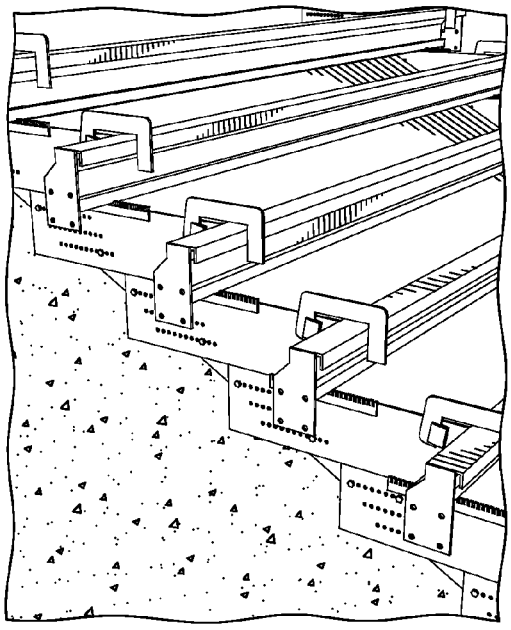
Figure 8A:
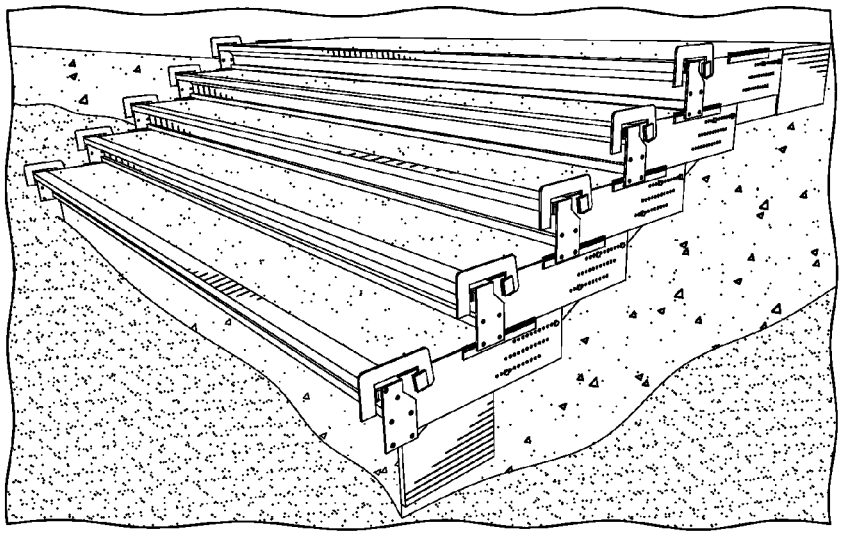
FIG. 8 shows the metal casing system depicted in FIGS. 2, 3 and 7, fully installed on two wood beams fixed on each side of a concrete footing following concrete pouring showing fully formed steps. A is a side view of concrete stairs built using the metal casing system of the present invention with fully formed steps. B is an enlarged side view of the metal casing system depicted in A with fully formed steps.
Figure 8B:
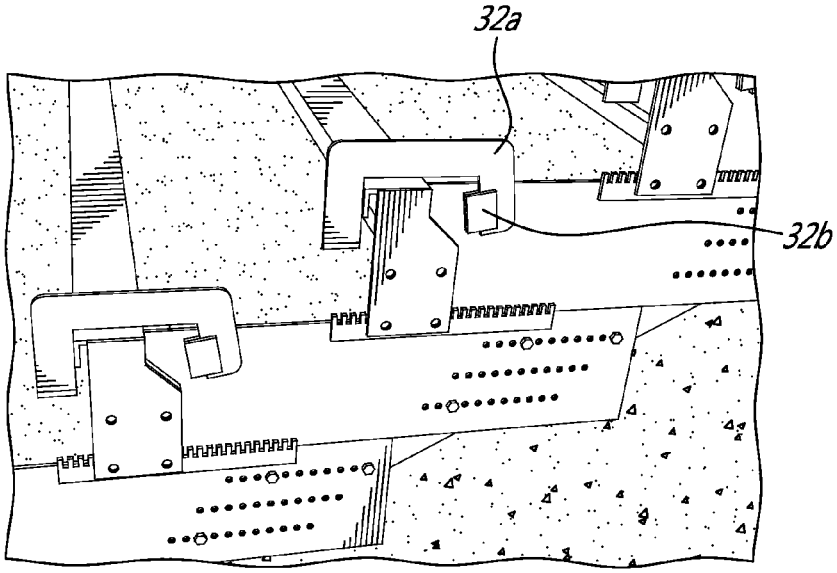

As shown in FIGS. 2 and 3, the riser member (30) is supported by the side plate (22) located below by a support member (28). In an embodiment, the support member is in the shape of a comb located (28*a*, see FIG. 5A) on the upper portion of the side plate (22). The support member (28) can be integrally formed with the side plate (22) or it can be a separate piece welded or otherwise secured to the side plate (22). In a preferred embodiment, the riser member (30) is fitted between two teeth of the comb (28*a*) to prevent the riser member (30) from moving under the weight of concrete. The comb (28*a*) shown in FIG. 5A is 12¼ inches long and 1½ inches high. It is also made of ¼ inch thick steel. The presence of multiple channels between the teeth allows to position the riser member (30) on the side plate (22) below and thus, further allows to adjust the depth of a tread. Typically, as in the case of the comb 28*a* shown on FIG. 5, each tooth corresponds to a depth of ½ inch. Typical tread depths are 9" and 25" inches but depths in between these values as well as smaller or larger depths are possible. Alternatively, and as shown in FIGS. 3 and 5B, the support member can be in the shape of a small plate comprising a single indentation (28*b*) to fasten the riser member (30) to the side plate (22). The support member (28*b*) shown on FIG. 5B is 1½ inches×1½ inches and made in ¼ inch thick steel. This support member is preferably used in the embodiment shown on FIG. 11, where the side plate defines the side of several stairs In such a case, the depth of the tread of a stair cannot be further adjusted using the support member. This type of support member (28*b*) is typically used to secure the first riser to create the stair that is closest to the ground. Also, the upper portion of the riser member (30) may advantageously be further fastened to the side plate (22) by any appropriate fastening means (32). In the particular embodiment shown in FIGS. 2, 3, 7 and 8, the fastening means (32) is in the form of a c-shaped clamp or hook (32*a*) which can be detachably attached to the side plate (22) via a locking member (32*b*) (best shown on FIG. 8B). The c-shaped clamp is hammered in place and joins the outer edge of the rise and the locking member on the side plate (22) and helps the rise to stay in place under the weight of concrete. Preferably, the c-shape clamp and locking member are made of ½ inch thick steel. Of course, any other kind of clamp or fastening means may be used in accordance with the present invention.

In an embodiment, the system of the present invention can be used to build concrete stairs along a wall structure. Under such circumstances, a relay plate (34) can be used to fasten the riser member (30) to the wall. A relay plate (34) is affixed on at least one extremity of the riser member (30). As for the riser member (30), the relay plate (34) has a shape that is complementary to the side plate (22) to provide for the appropriate shape of nosing (18) or absence thereof.

From the foregoing description, it should be apparent that side plates (22), riser member (30) support member (28), fastening means (32) and relay plate (34) form a structure which, when erected at the building site, constitutes a formwork which receives a settable material in a fluent state such as unhardened concrete to create a flight of stairs. Upon setting of the concrete, the system is dismantled and ready to be used on the next job site.

Furthermore, one skilled in the field of building concrete stairs will appreciate that the system of the present invention can be modified to accommodate different rise height, tread width and nosing shapes and sizes. For example, side plate (22), riser member (30) and relay plate (34) can be made into various sizes and shapes based on the desired measures of the stair structure and of the desired look of the stairs. The nosing (18) can be of any shape and form. It can be present or absent. If present, the nosing (18) can be limited to the width of a tread as shown for example, in FIGS. 1, 3, 8 and 9 or it can be carried laterally on the side of the step along its depth. It serves mainly an esthetic function and may be present or not, on all or some of the stairs. A combination of different nosing may also be used.

Furthermore, in accordance with the present invention, the side plates (22), riser member (30), relay plates (34), support member (28) and fastening means (32) may be of any suitable material which is durable and sufficiently strong. The various pieces in the above described system can be of the same material or may be of different materials. The side plates (22) and riser members (30) must be in a material which is sufficiently strong and resistant which does not bend under the pressure of the unhardened concrete. Fastening means (32), support members (28) and relay plates (34) may be made of other less resistant reusable material since these pieces do directly bear the load of unhardened concrete. Exemplary particularly suitable materials include aluminum, tungsten and steel. Preferably, the side plates (22), riser member (30), support member (28), fastening means (32) and relay plates (34) are made of stainless steel. In a particular embodiment, the stainless steel is ¼ inch stainless steel.

The system of the present invention for building formwork to build concrete stairs is typically used in the following manner: 1) a typical stair footing is first build (e.g., concrete footing or gravel and concrete footing); 2) preferably, a supporting structure or stringer (such as a 2×4 wood beam or plywood sheet) is then temporarily secured to the footing (in order to avoid damaging the footing when securing the side plates (22); 3) side plates (22) are then screwed or nailed to the supporting structure. If building a flight of stairs with two open sides; at least two sets of side plate(s) (22) are installed; one on each side of the stair flight (i.e., one facing the other); 4) one or more riser members (30) are then placed on each side plates and secured in place; 5) unhardened concrete or other suitable material is poured on the footing or base, between the side plates (22) and riser members to form each step; and 6) once concrete has hardened, the side plates (22) and riser members (30) are dismantled, and the supporting structure (if any) is removed, thereby completing the building of a concrete flight of stairs. A sand finish is preferably applied on the base or footing, which will hide the holes made in the concrete to fix the supporting structure. All pieces (ex. side plates (22), riser members (30); relay plates, etc.) are reusable and can be used to build a different flight of stairs on another building site.

Although the present invention has been described hereinabove by way of specific embodiments thereof, it can be modified, without departing from the spirit and nature of the subject invention as defined in the appended claims.

The invention claimed is:

1. A casing system for building a formwork for building concrete stairs comprising:

a) at least one side plate which can be releasably secured to a supporting structure on a footing; said side plate defining a side of at least one stair and defining the depth of a tread of said stair;

b) at least one riser member for defining the rise of said at least one stair; said riser member being complementary to said side plate; and c) a clamp for fastening the riser member to the side plate; wherein said side plate and riser member are reusable.

2. The system of claim 1, wherein said side plate comprises holes enabling to releasably secure the side plate to the supporting structure.

3. The system of claim 1, wherein said side plate is releasably secured to said supporting structure using screws or nails.

4. The system of claim 2, wherein said side plate can be used to build treads of varying depths.

5. The system of claim 4, wherein said varying depths is between about 9 inches and 25 inches.

6. The system of claim 3, wherein said side plate defines the side of at least 4 stairs.

7. The system of claim 6, wherein said side plate is integrally formed.

8. The system of claim 1, wherein said side plate and said riser member further defines a nosing along said tread.

9. The system of claim 1, wherein said side plate further comprises a support member for supporting a riser member.

10. The system of claim 9, wherein said support member is integrally formed with the side plate.

11. The system of claim 9, wherein said support member comprises an indentation to receive said riser member.

12. The system of claim 9, wherein said support member is a comb having multiple teeth and indentations to receive said riser member.

13. The system of claim 1, wherein said clamp is a c-shaped clamp and said side plate further comprises a locking member to lock said clamp on said side plate.

14. The system of claim 1, wherein said side plate and riser member are comprised of steel.

15. The system of claim 1, wherein said riser member is up to 12 feet long.

16. The system of claim 1, further comprising at least one relay plate for securing the riser member to a wall.

17. A method for building concrete stairs comprising building a formwork comprising the casing system of claim 1.

* * * * *